US007997197B2

(12) United States Patent
Wieland et al.

(10) Patent No.: US 7,997,197 B2
(45) Date of Patent: Aug. 16, 2011

(54) CLOSABLE INK CARTRIDGE FOR PRINTER ROLL

(75) Inventors: Rainer Wieland, Würzburg (DE); Peter Schmitt, Würzburg (DE)

(73) Assignee: KBA-Metronic AG, Veitschochhelm (DE)

( * ) Notice: Subject to any disclaimer, the term of this patent is extended or adjusted under 35 U.S.C. 154(b) by 433 days.

(21) Appl. No.: 12/203,970

(22) Filed: Sep. 4, 2008

(65) Prior Publication Data

US 2009/0056574 A1 Mar. 5, 2009

(30) Foreign Application Priority Data

Sep. 4, 2007 (DE) ..... 10 2007 041 755

(51) Int. Cl.

| | |
|---|---|
| ***B41F 31/02*** | (2006.01) |
| ***B41F 31/06*** | (2006.01) |
| ***B41F 31/07*** | (2006.01) |
| ***B41F 9/10*** | (2006.01) |

(52) U.S. Cl. ..... 101/350.6; 101/169; 101/364

(58) Field of Classification Search ..... 101/350.6, 101/364, 363, 366, 159, 157, 350.1
See application file for complete search history.

(56) References Cited

U.S. PATENT DOCUMENTS

| | | | | |
|---|---|---|---|---|
| 5,862,756 | A * | 1/1999 | Gorter | 101/364 |
| 6,095,045 | A * | 8/2000 | Petersen et al. | 101/350.6 |
| 6,335,098 | B1 * | 1/2002 | Kutzner et al. | 428/422 |
| 7,234,396 | B2 | 6/2007 | Kleinschnitz | 101/350.6 |
| 2005/0081729 | A1 | 4/2005 | Kleinschnitz et al. | 101/350.6 |
| 2008/0295718 | A1 | 12/2008 | Kleinschnitz et al. | |
| 2009/0056573 | A1 * | 3/2009 | Wieland et al. | 101/350.6 |
| 2009/0058965 | A1 * | 3/2009 | Wieland et al. | 347/86 |

FOREIGN PATENT DOCUMENTS

| | | |
|---|---|---|
| EP | 1090756 | 4/2001 |
| WO | WO 0216137 | 2/2002 |

* cited by examiner

*Primary Examiner* — Daniel J Colilla
*Assistant Examiner* — Leo T Hinze
(74) *Attorney, Agent, or Firm* — Andrew Wilford

(57) ABSTRACT

A printer having a roll with a radial outer roll surface has an ink cartridge having a housing itself having a pair of side walls and a pair of end walls bridging the side walls and defining therewith a downwardly open mouth juxtaposed with the roll surface. One of the side walls is shiftable between an outer position defining a relatively large volume and an inner position. Doctor blades supported on the housing have outer edges resiliently engageable at the mouth with the surface. One of the doctor blades is shiftable between an open position with its outer edge spaced from the other doctor blade and a closed position. A mechanism connected to the one wall and to the one doctor blade shifts the one doctor blade between the open position and the closed position and simultaneously shifts the one wall from the inner position to the outer position.

7 Claims, 3 Drawing Sheets

CLOSABLE INK CARTRIDGE FOR PRINTER ROLL

FIELD OF THE INVENTION

The present invention relates to a printing machine or unit. More particularly this invention concerns a closable ink cartridge for an ink-transfer roll.

BACKGROUND OF THE INVENTION

A standard printer has an ink-transfer or anilox roll that is fed ink from a supply cartridge that sits atop the transfer roll and that fits tightly with the roll so that a body of ink held in the supply sits atop the roll. Such a supply has a pair of doctor blades that have outer edges that engage the roll along lines parallel to the axis thereof, with the space between these lines forming a downwardly open ink-feed mouth. As the roll rotates, its surface is wetted, and excess ink is scraped off the roll by the downstream doctor blade.

In order to change the supply or roll, it is standard as described in U.S. Pat. No. 7,234,396 to make one of the doctor blades movable and couple it to a mechanism that allows it to be shifted from an open position with its outer edge spaced from the outer edge of the other doctor blade to a closed position with its outer edge engaging the other blade and closing the mouth. When thus closed the supply and roll can be separated while the supply continues to hold a body of ink.

The ink supply typically has a frame-like shape with two short opposing end plates and two opposing long side plates, the latter extending parallel to the roll axis. Each side plate carries a respective doctor blade. Optionally, one side plate can directly form a doctor blade.

In order to apply ink, the two outer edges of the doctor blades are prestressed radially inward against the ink-transfer roll so that a rolling ink body is formed by the rotation of the ink-transfer roll against the downstream doctor blade, and the ink is transferred from this ink body onto the ink-transfer roller. The upstream doctor blade opposite the downstream doctor blade essentially functions here to seal the opening of the ink supply relative to the ink-transfer roll when the ink-transfer roll is stationary, i.e. when the ink located in the ink supply is completely distributed within the ink supply.

Frequently a change must be made in a printing machine or unit from one ink to another ink, meaning that either the corresponding ink cartridge must be completely emptied and cleaned, which entails a significant labor-intensive and time-intensive effort for the machine, or, on the other hand, an ink cartridge including the ink contained in the ink cartridge must be switched with another.

Changing an ink cartridge presents a problem, particularly when printing ink is left in the ink cartridge, since this ink runs out through the opening of the ink cartridge between the two edges of the doctor blades onto the ink-transfer roll when the ink cartridge is lifted off the ink-transfer roll, and possibly onto other internal elements of a printer, thereby contaminating the machine.

In order to avoid these problems, the approach known in the art is either to completely drain an ink cartridge before changing it, or before the change to have a service person remove the ink remaining in the ink cartridge manually or to remove it by a controlled suction device. However, this procedure is labor-intensive and time-intensive, in particular whenever the ink cartridge is still almost completely filled.

Another approach known in the art is as described above to design ink supplies such that the opening between the doctor blades can be closed toward the ink-transfer roll, where provision is made whereby the ink along with an ink module, i.e. a cartridge matched to the interior of the ink cartridge is introduced into the ink cartridge, the container being first closed toward the ink-transfer roll by means of an additional closure plate.

In operation, this plate is removed and the ink is able to pass to the ink-transfer roll. Whenever the ink needs to be switched, this plate is re-introduced and closes the opening to the ink-transfer roll, thereby allowing the ink module together with the ink therein to be removed. A disadvantageous aspect of the described approach is the fact that the printing ink that passes during normal operation onto the doctor blades remains there during removal of the ink module, and ink also continues to pass between ink module and ink cartridge, with the result that both the outer area of the ink module after removal and the now inner area of the ink cartridge have to be cleaned.

In addition, an increased amount of ink remains on the ink-transfer roll in the area of the opening of the ink cartridge facing the ink-transfer roll since the additional module plate runs in guide grooves in the ink module and as a result the ink-transfer roll cannot be wiped off. This also disadvantageously results in an increased cleaning cost for the ink-transfer roll itself and, in particular, in an associated high ink consumption when the ink is changed frequently.

Another approach is known in the art whereby the ink cartridge is closed toward the ink-transfer roll by a doctor blade that is attached to a doctor bar and is movable along with the doctor bar, wherein the doctor bar is moved along with the doctor blade attached thereto onto the opposing doctor blade. This type of ink cartridge is revealed, e.g. in U.S. Pat. No. 7,234,396. What is disadvantageous about this type of closure is that the compartment volume of the ink cartridge is significantly diminished by the displacement of the doctor bar together with the doctor blade, such that there is a risk of overflow, particularly when the ink cartridge is filled completely or almost completely, thereby causing printing ink to pass in uncontrolled fashion into the printer. What is furthermore disadvantageous is the fact that before this type of ink cartridge is removed from a holder of a printer the service personnel must ensure that the ink cartridge is closed tightly. Otherwise ink will accidentally discharge from the ink cartridge during the removal operation.

OBJECTS OF THE INVENTION

It is therefore an object of the present invention to provide an improved ink cartridge for a ink-transfer roll.

Another object is the provision of such an improved ink cartridge for a ink-transfer roll that overcomes the above-given disadvantages, in particular where the volume of the ink cartridge remains at least essentially constant when closed and which enables an ink change to be effected even when the ink cartridge is completely filled.

A further object of the invention is to provide an improved ink cartridge of the generic kind that enables an ink change to be effected quickly and easily without allowing any ink remaining in the ink cartridge to drip into the printer, while at the same time minimizing the cleaning effort.

Yet another object to be attained by the invention is to create an ink cartridge with which it is possible to effect an ink change with a minimum loss of ink.

A further object or the invention is to create an ink cartridge that has the referenced properties and that closes automatically when removed from the printer, thereby largely precluding operating error.

SUMMARY OF THE INVENTION

A printing machine having a roll rotatable about an axis having a radially outwardly directed roll surface, has according to the invention an ink cartridge having a housing itself having a pair of side walls and a pair of end walls bridging the side walls and defining therewith a downwardly open mouth juxtaposed with the roll surface. One of the side walls is shiftable between an outer position defining with the other walls a relatively large volume and an inner position defining with the other walls a smaller volume. Respective doctor blades supported on the housing flank the mouth and have outer edges resiliently engageable at the mouth with the surface so that a body of ink can be held between the blades and engage the surface between the outer edges of the blades. One of the doctor blades is shiftable on the housing between an open position with its outer edge spaced from the outer edge of the other doctor blade and a closed position with the outer edges engaging each other and the blades closing the mouth. A mechanism connected to the one wall and to the one doctor blade shifts the one doctor blade between the open position and the closed position and generally simultaneously shifts the one wall from the inner position to the outer position.

Thus according to the invention there is a compensatory motion effecting an increase in volume by at least one subsection of at least one wall defining the ink-holding compartment of the ink cartridge during the closing motion of at least one of the doctor blades.

Since the invention is employed preferentially in printers that use anilox rolls for the transfer of ink, the following discussion uses the term roll to cover both an anilox roll and ink-transfer roll.

The essential core idea on which the invention is based is that while a volume reduction can occur as a result of the closing motion and the parts of the ink cartridge moved thereby, what is provided, however, is an approach whereby this volume reduction is counteracted by the fact that at least one part of a wall defining the volume can be moved so as to cause an increase in volume.

This volume increase can be formed upstream shortly in advance of the closing motion and volume reduction associated therewith, or, in an especially preferred approach, take place simultaneously. For example, this can be effected by having the mechanism bring about the closing motion simultaneously with the compensatory motion.

By means of the volume increase during the compensatory motion, provision is made whereby a volume reduction generated by the closing motion is at least essentially compensated preferably simultaneously, and thereby keeps the overall volume at least essentially constant. In particular, this is in particular understood to mean that the volume is not reduced by more than 10% during the closing action. As a result, the ink cartridge is effectively prevented from overflowing even if this compartment is closed when still in a completely filled state.

The opening formed in the ink cartridge between the edges of the doctor blades can be closable by a motion of the doctor blades relative to each other and/or by an additional motion of at least one part of a wall of the ink cartridge such that, on the one hand, the internal volume of the ink cartridge remains essentially constant and, on the other hand, the printing ink applied to the anilox roll carrying the ink cartridge is wiped off the anilox roll and the wiped-off printing ink is transported back up into the ink cartridge.

To this end, provision can be made whereby the moved wall is formed by a doctor blade and this doctor blade, which in particular is mounted on a side plate of the ink cartridge or directly forms this compartment, is drivable into a superimposed straight-line and rotary motion by the mechanism. This way the possibility exists according to the invention to produce both effects according to the invention by a single motion, that is, the closing that is generated at least essentially by the linear motion component in which the outer edge of one doctor blade is swept over the outer surface of the ink-transfer roll toward the outer edge of the opposing doctor blade, and also by the rotary motion component that constitutes at least essentially the compensatory motion.

As a result, due to the superimposition of a linear and a rotary motion of the doctor blade, at least one part of the wall of the ink cartridge can simultaneously effect a corresponding radiative and/or straight-line motion, thereby ensuring that the inner volume of the ink cartridge for receiving ink remains essentially constant.

As a result, e.g. due to the superimposed motion during the closing motion, a lower section of the moved doctor blade can move toward the opposing doctor blade, and simultaneously an upper section moves away from the opposing doctor blade. For example, due to the superimposition of motions, the moved doctor blade can be shift effectively outward and simultaneously rotate and/or slide to the right and simultaneously rotate counterclockwise. Since only one part is moved here to effect the closing and compensatory motion, that is, the doctor blade, or the side wall of the ink cartridge carrying the doctor blade, the closing motion and compensatory motion are always exactly simultaneous.

In a preferred embodiment, provision can also be made whereby the ink cartridge relative to the anilox roll, immediately before removal or during removal of the ink cartridge from the anilox roll, is closed completely and automatically toward the anilox roll, with the result that no printing ink can discharge from the ink cartridge toward the anilox roll.

For example, the ink cartridge can be mounted in the printing unit of the printing machine in a stationary holder from which the compartment is removable, the opening between the doctor blades during removal being automatically closed by the effective connection between the mechanism of the ink cartridge and the holder. To this end, the mechanism can have an actuating element and at least one locking element coupled thereto that is engageable with the holder.

As a result, by means of manual or automatic actuation of the mechanism the latching the ink cartridge in a stationary holder on the printer can be releasable such that the ink cartridge is removable from the holder, the closing being effected simultaneously by this mechanism.

According to the invention, a provision can be made whereby in one embodiment the two doctor blades are movable relative to each other, wherein either both doctor blades can be movable simultaneously relative to each other, or one doctor blade can be fixed and the other doctor blade can be movable relative to this plate.

Accordingly, by means of an appropriate selection of the respective motions a result can be achieved whereby the two edges of the doctor blade, on the one hand, move toward each other so as to first reduce the opening between the edges of the doctor blades during the relative motion until the opening is completely closed when the doctor blades touch, and, secondly, at least one of the doctor blades is guided at its outer edge over the surface of the anilox roll, thereby wiping off the printing ink from the surface of the anilox roll and transporting it into the ink cartridge. The opening here between the edges of the doctor blades can preferably be closable by the above-referenced rotary and linear motion of at least one doctor blade.

In order to create an appropriate mechanism, for example, at least one of the side walls of the ink cartridge to which the doctor blades are attached by appropriate holders can be movably supported, thereby enabling the side wall with the doctor blade located thereon to be pivoted by a lever arrangement or a guide arrangement in such a way, e.g., that, on the one hand, the doctor blade by its outer edge effects a linear and/or rotary motion about a first virtual axis, and, on the other hand, the edge of the side wall facing away from the doctor blade effects a linear and essentially contra-directional rotary motion.

Due to the corresponding implementation of the referenced lever arrangement or guide arrangement, and the associated selection of the respective associated rotational axes running parallel to the cylinder axis, what is achieved is that the ink cartridge volume enclosed by all walls of the ink cartridge remains at least essentially constant independently of the position of the movable side wall and of the doctor blade located thereon.

In order for the ink cartridge in the printing unit to operate, it is necessary here for the ink cartridge fit with its holder such that the opening formed by the doctor blades rests tightly against the anilox roll and the printing ink can be transferred from the ink cartridge onto the ink-transfer roll.

According to the invention, provision can be made whereby the referenced motions are implementable by a mechanism mounted on/in the ink cartridge, by which mechanism the ink cartridge is closed in the manner described toward the anilox roll, in particular, whereby simultaneously the anchorage of the ink cartridge is released and the ink cartridge is removable from the referenced holder, and thus out of the operating position.

In the referenced embodiment, provision can be made whereby the outer edge of at least one of the doctor blades is moved toward the outer edge of the opposing doctor blade and the doctor blade edges touch or overlap each other such that the ink cartridge is closed thereby.

With reference to the implementation of the rotary motion, provision can be made here whereby at least one doctor blade is rotatable about a rotational axis extending longitudinally relative to the ink cartridge, this rotational axis being spaced apart from one edge of a doctor blade. Due to the spacing of the rotational axis from one edge of a doctor blade, a radius is accordingly defined on which the edge of the doctor blade moves on a circular path about the rotational axis, wherein this circular path can be formed by the appropriate selection of the position of the rotational axis such that the opening between the edges of the doctor blade facing the ink roll is first reduced until the opening is completely closed when the doctor blades touch. The rotational axis itself can be translatable, thereby producing the superimposition of the motions.

Provision can be made here whereby only one doctor blade is rotatable about a rotational axis and the edge of the doctor blade facing the anilox roll moves toward the fixed doctor blade on the opposite side. As a result, the volume of at least the lower section of the ink cartridge facing the anilox roll is reduced first, with the result that there exists the risk of overflow particularly when the ink cartridge is filled.

In order to simultaneously keep the volume of the overall ink cartridge essentially constant, provision can furthermore be made whereby the movable side wall itself is moved with a counter-directional motion about the same or another rotational axis such that the volume of the upper section of the ink cartridge is increased by approximately the same amount and the inner volume of the ink cartridge remains essentially constant.

In an alternative embodiment, it is also possible to design the two doctor blades in a rotatable fashion about the respective rotational axis such that the two edges of both doctor blades move toward each other simultaneously. What is simultaneously provided thereby is to have at least one of the side walls, as described, effect a complementary motion about an additional rotational axis such that the inner volume of the ink cartridge remains at least essentially constant.

In regard to the referenced motions, it can be advantageous to effect a linear motion of the doctor blade and/or of the side walls in addition to a rotary motion, thereby avoiding, for example, any excessive deformation of the doctor blades.

An especially simple design by way of example of an ink cartridge according to the invention for providing an linear motion, e.g., of a movably mounted doctor blade relative to a fixed doctor blade can be produced, for example, by an approach whereby an ink cartridge has two end-face side shields between which the respective doctor blades along with the doctor blades are mounted on mutually parallel side walls, wherein the first doctor blade attached to a first doctor blade is permanently attached to a side wall, while the second doctor blade attached to a second doctor blade is attached to a second side wall such that the second doctor blade of the second side wall is shiftable within the holder. At the same time, the side wall has a rotational axis by which in response to a motion of the doctor blade within the holder the edge of the side wall opposite the doctor blade effects such a rotational motion that this motion is essentially in opposition to the motion of the outer edge of the doctor blade, with the result that the inner volume of the ink cartridge remains essentially constant.

What results from this type of design is an ink-cartridge housing formed by two long side walls and two shorter end walls, with the end walls fixed relative to each other and at least one of the side walls is movable, effectively forming a rectangular frame open upward and downward. In a simple arrangement, the movable side wall has at each end edge two vertically spaced and axially projecting end rollers engaged in grooves of the respective end plate, so that as it moves up and down it changes angle to the vertical and effects the necessary volume compensation.

In an especially preferred embodiment of the invention, provision can furthermore be made whereby the straight-line path and the rotational path of the shiftable side wall are defined by the path of the guide slots within each end plate. In this case, provision can be made whereby the guide slots are not straight or part circular, in particular, in each case constitute a curve bent into itself that reproduces, on the one hand, the path of the circumferential surface curvature of the ink-transfer roll, and, on the other hand, ensures a constant inner volume of the ink cartridge.

What is in particular achieved thereby is that during translation of the shiftable doctor blade onto the fixed doctor blade the edge of the simultaneously jointly moved doctor blade does not lift from the anilox roll during this translation, with the result that the seal of the ink cartridge relative to the anilox roll is ensured until the opening between the edges of the doctor blades is completely closed.

In particular, the guide slots in the end plates can be designed such that during shifting of the shiftable doctor blade either the edge of the shifted doctor blade sits precisely on the edge of the fixed doctor blade, or, on the other hand, in an especially preferred embodiment the edge of the doctor blade, in particular of the shifted doctor blade, contacts the surface of the other doctor blade, in particular, of the fixed doctor blade. This achieves an especially effective seal of the ink cartridge since the face of the edge of the shiftable doctor blade can be pressed with sufficiently large force onto the surface of the other doctor blade.

In an alternative design of the mechanism, provision can also be made whereby two pivots on one movable doctor blade are connected by respective links to two separate pivots on the fixed housing of the ink cartridge in a nonparallelogrammatic manner, that is the links are of different lengths and/or the pivots are differently spaced so that the movable side plate does not move in a straight line. When the lower arm is shorter than the upper arm, as the side wall moves up, it will become more erect, thereby pushing in its upper section more than its lower section and decreasing the ink compartment's volume.

According to the invention, provision can furthermore be made whereby the doctor blades are sealed in an ink-tight manner toward the end-mounted end plates of the ink cartridge as soon as the ink cartridge is also closed on the face toward the ink roll so as to prevent discharge of printing ink from the ink cartridge between the side shields and the doctor blade.

In order to ensure this in the above-described design, provision can be made whereby an appropriate sealing device is mounted on each of the end plates, e.g. in the form of a closure element that seals the front face of the ink cartridge against ink being discharged. This device must have a sealing effect in particular immediately before and after removal of the ink cartridge from the holder, for example, by an approach whereby one flexible seal body each is inserted as a closure element into each end plate of the ink cartridge in the area of the end edges of the doctor blades, this element being pressed onto the respective end edges of the doctor blade, for example, by a respective device immediately before removal of the ink cartridge from the holder, in particular, by deforming and/or shifting the material.

This can be achieved, for example, by installing one eccentric roller cam on each side of the flexible body facing away from the ink cartridge, so that the outer surface of the eccentric roll acts on the respective flexible body such that at a predetermined position of the respective eccentric roll this material is pressed onto the corresponding edges of the doctor blades. Control of the position for the eccentric rolls can be also be effected according to the invention by means of the mechanism for moving the doctor blades, such that when the ink cartridge is closed toward the ink-transfer roll the end plates facing the edges of the doctor blades are also closed, thereby resulting in an ink cartridge that is completely closed toward the printer.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
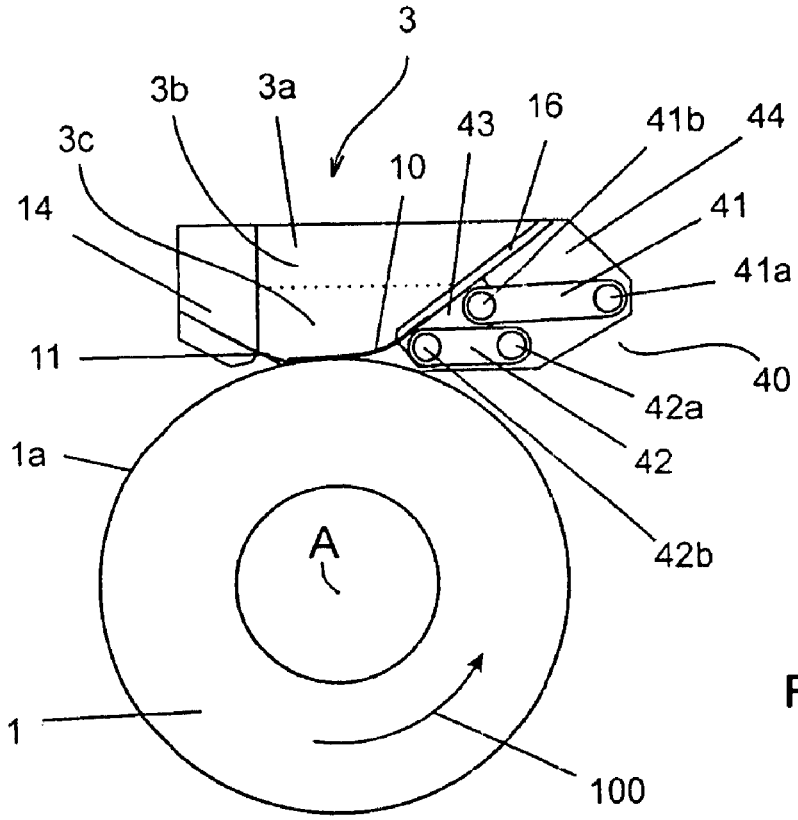
FIG. 1 is a partly schematic side view illustrating the system of this invention in the closed position.
Figure 2:
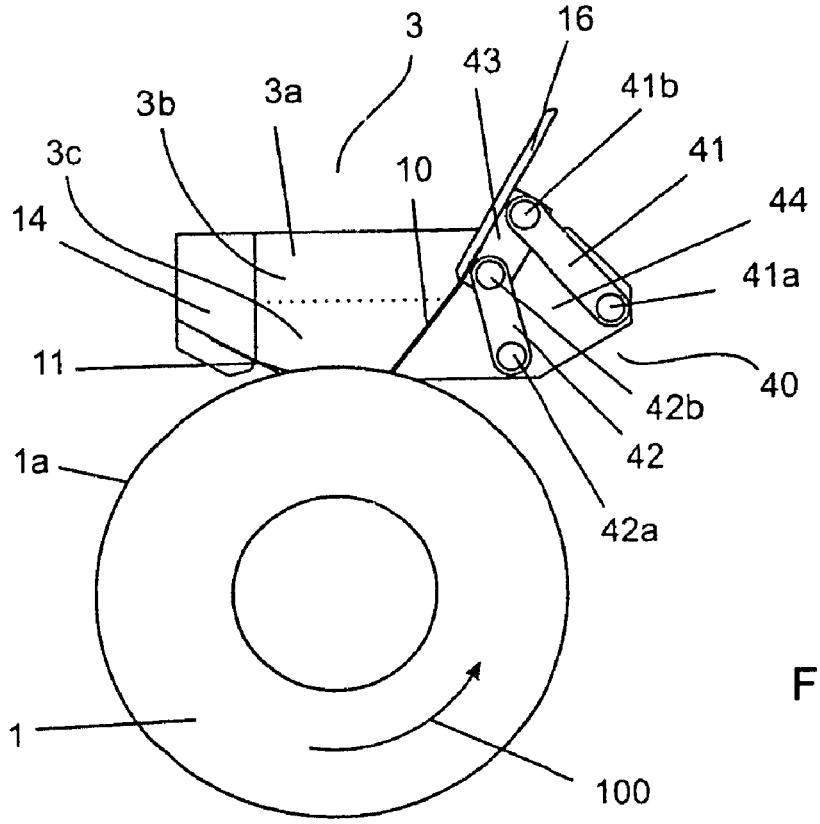
FIG. 2 is a view like FIG. 1 in the open or use position.

As seen in FIGS. 1 and 2 printer has an anilox or ink-transfer roll 1 with a cylindrical outer surface 1*a* centered on a normally horizontal axis A and normally rotated in a direction 100. The surface of this roll 1 is normally formed with an array of tiny cavities that are filled with ink by an ink supply cartridge 3 according to the invention, the ink subsequently being transferred to an actual printing roll for application to a web or sheet workpiece.

The cartridge 3 here has a pair of side walls 14 and 16 extending in planes generally parallel to the axis and bridged by end walls 2*a* and 2*b* (FIGS. 3-5) extending perpendicular to the axis A. The wall 14 is fixed and the wall 16 is movable as described below. Together these walls 2*a*, 2*b*, 14, and 16 define a housing in turn defining a compartment 3*a* subdivided into a lower portion 3*c* and an upper portion 3*b* above the lower portion 3*c*. The compartment 3*a* is open downward at a mouth 30 that in use is open and through which the ink of the body 3*c* can directly contact the surface 1*a*.

A fixed doctor blade 11 is secured to the side wall 14 and a movable doctor blade 10 is fixed to the side wall 16. Both blades 10 and 11 are made of a thin sheet of stainless steel so that they are quite flexible and bear elastically against the outer surface 1*a*. In the normal use position of FIG. 2 the outer edges of the two blades 10 and 11 engage the outer surface at an angular spacing and extend parallel to each other so that the mouth has a perfectly rectangular shape. As the roll 1 rotates in the direction 100 its surface is coated by the ink, and excess ink is scraped off by the downstream fixed blade 11 to leave an accurately dosed amount on the surface downstream of this blade 11. This is standard.

In order to remove the ink cartridge, for instance to change ink or to clean it, it is standard as in above-cited U.S. Pat. No. 7,234,396 to shift the blade 10 from the FIG. 2 open position to the FIG. 1 closed position. During this movement the edge of the blade 10 scrapes over the surface 1*a* and cleans most of the ink off it, and when the blade 10 engages the blade 11, the mouth is closed.

According to the invention the side wall 16 is attached to a mechanism 40 that enables the side wall 16 along with its doctor blade 10 to be moved such that, on the one hand, the outer edge of doctor blade 10 effects an essentially linear motion and in doing so passes over the surface 1*a* of the roll 1, thereby wiping this off, and on the other hand, side wall 16 along with doctor blade 10 effects a tilting or rotational motion. As a result, the inner volume of the ink cartridge according to the invention remains essentially constant.

When the ink cartridge 3 is closed, as shown in FIG. 1, the volume of the lower portion 3*c* is reduced by a predetermined fraction as the side wall 16 moves inward and the doctor blade 10 moves over the surface 1*a*, effectively raising the "floor" of the lower portion 3*c*. According to the invention, the size of the upper portion 3*b* and the upper part of the lower portion 3*c* is increased by an outward movement of the upper part of the wall 16, so that the depth of the body of ink remains essentially the same. Even if the compartment 3*a* is filled nearly to the brim, closing the mouth 30 will not cause it to overflow.

The mechanism 40 here comprises, for example, a fixed base plate 44 on which two arms 41 and 42 are pivoted. At outer ends the arms 41 and 42 are pivoted on shafts 41*a* and 42*a* that are carried on the base plate 44. The inner ends of the arms 41 and 42 are secured on pivots 41*b* 42*b* to a flange 43 of the side wall 16. The pivots 41*b* and 42*b* are closer together than the pivots 41*a* and 42*a* and/or the link 42 is shorter than the link 41 so that the angle of the wall 16 changes as it moves up and down, thereby effecting the above-described equalization of the volume of the compartment 3*a* as the result of a combined linear and tilting movement. The result of this nonparallelogrammatic linkage is therefore a combined linear and pivoting movement as the wall 16 moves up and down. The flexible doctor blade 10 extends generally downward from the lower edge of the side wall 16.

Figure 3:
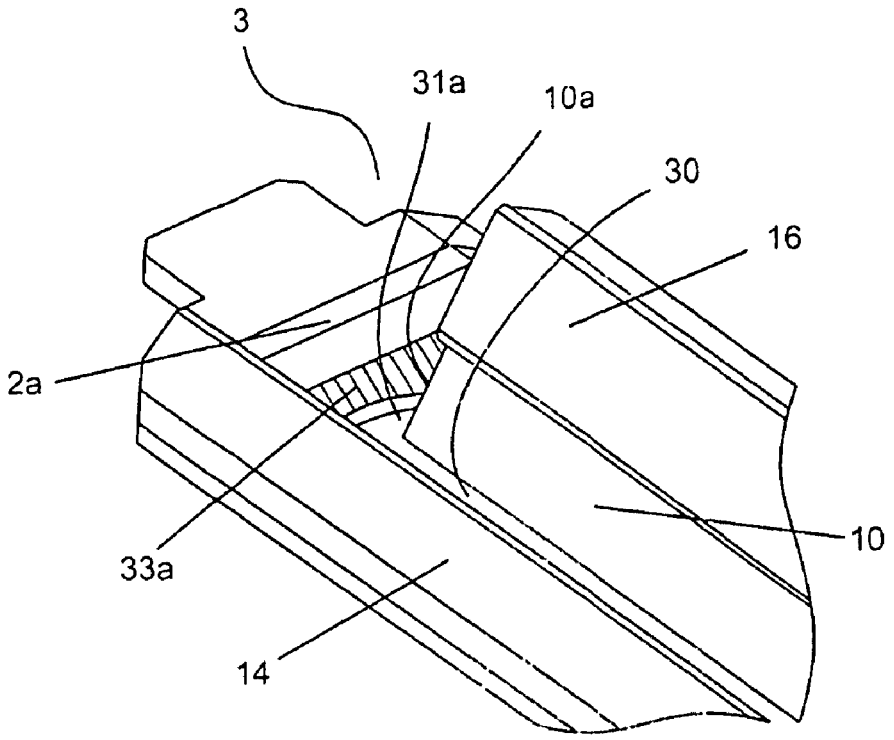
FIG. 3 is a perspective view of a detail of the ink cartridge according to the invention.

In order to seal the side shields of the ink cartridge relative to the end-face edges of the doctor blades and/or of movable side 16, a respective flexible body 33*a* and 33*b* is fitted in each of the end plates 2*a* and 2*b* at least in the area of end edges 10*a* and 10*b*, of the movable doctor blade 10 and/or the fixed doctor blade 11, as illustrated schematically in FIG. 3.

Since the mechanical unbalances of the roll, abrasion of the doctor blades 10 and 11, and other external factors, particularly in the case of a movable doctor blade, do not allow the doctor blades 10 and 11 to be permanently attached to the end plates 2*a* and 2*b* there are always between the end plates 2*a* and 2*b* and the end edges 10*a*, and 10*b* of the doctor blade 10 gaps 31*a* and 31*b* through which printing ink can discharge uncontrollably. If the ink cartridge is thus closed as described above by the doctor blade 10, it is still possible for printing ink to leak undesirably through these gaps 31*a* and 31*b* from it ink cartridge 3 when removed.

Figure 5:
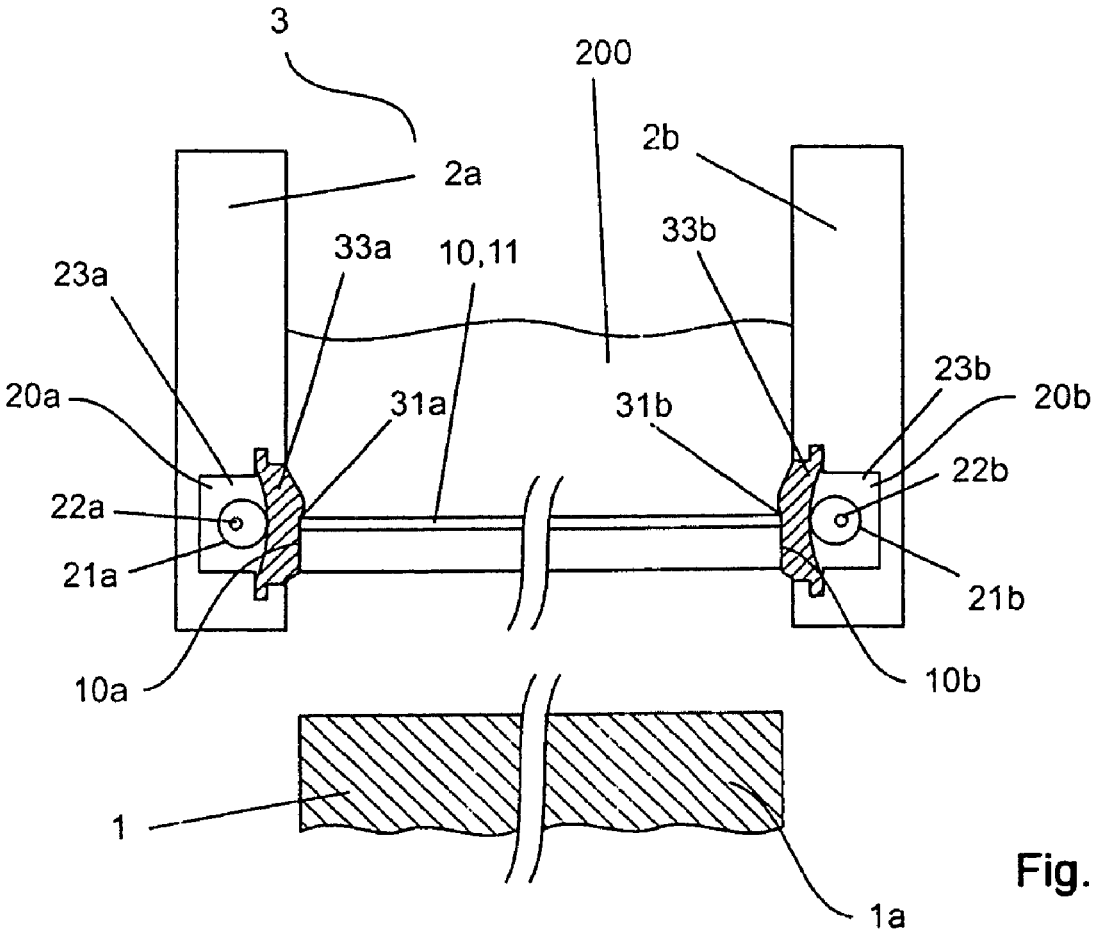
FIG. 5 is a view like FIG. 5 in the removed and closed position.

Thus according to the invention the flexible bodies 33*a* and 33*b* in the end plats 2*a* and 2*b* are pressed inward and deformed by respective actuator devices 20*a* and 20*b* at least when the ink cartridge 3 is closed such that the faces of the flexible bodies 33*a* and 33*b* turned toward the ink cartridge are pressed against the edges 10*a* and 10*b*, of the doctor blades 10 and 11, thereby closing the gaps 31*a* and 31*b*, as illustrated in FIG. 5.

The devices 20*a* and 20*b* here can have cylindrical cams 21*a* and 21*b* eccentrically supported on respective axes 22*a* and 22*b* in a cutouts or recesses 23*a* and 23*b* of the end plates 2*a* and 2*b*, the outer edges of the cylindrical cams 21*a* and 21*b* bearing on the flexible bodies 33*a* and 33*b*.

Figure 4:
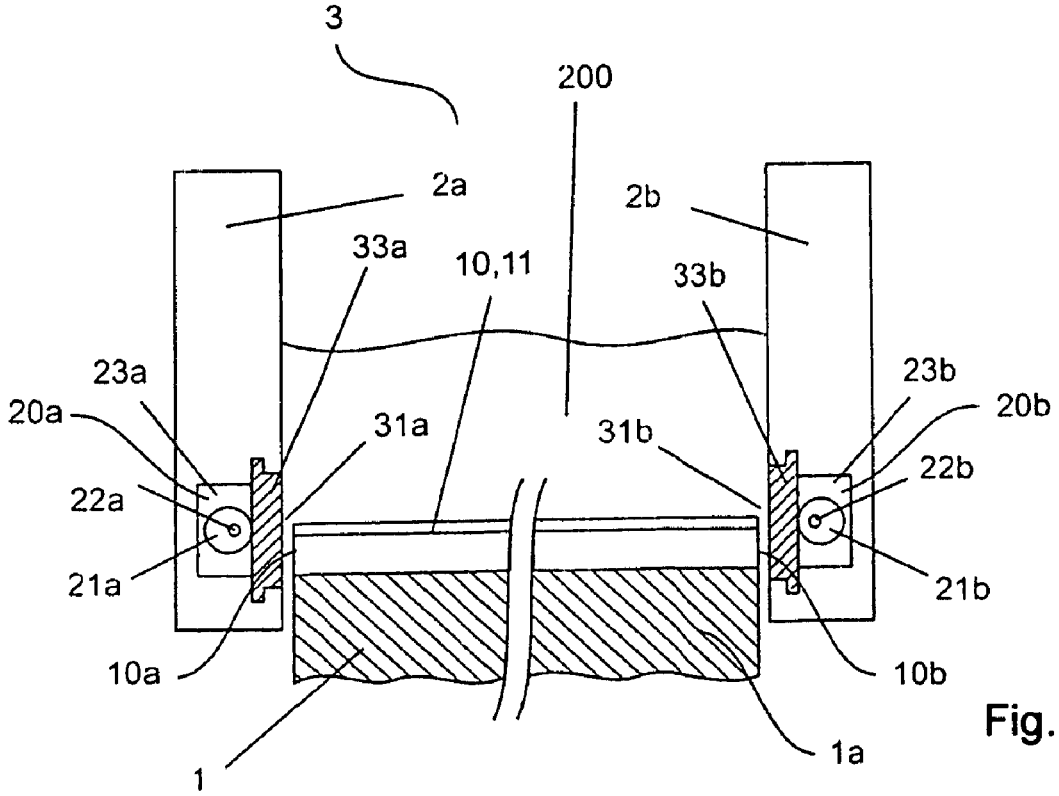
FIG. 4 is a partly sectional view through the ink cartridge in the open or use position.

In a first position of the cams 21*a* and 21*b*, as shown in FIG. 4, no pressure or only a minimal pressure is exerted on the flexible bodies 33*a* and 33*b*, with the result that these are not deformed, or are only negligibly deformed, and accordingly the gaps 31*a* and 31*b* are open. Conversely, in a second position of the cams 21*a* and 21*b*, as shown in FIG. 5, a force is exerted on the flexible bodies 33*a*, 33*b* and deforms them such that they are pressed onto the edges 10*a*, 10*b* of the doctor blade 10 and the gaps 31*a* and 31*b* close.

It is of course obvious that this type of seal can also be used on the edges of the movable side 16, the shape and size of the flexible bodies and the implementation of the devices 20*a* and 20*b* being adjusted accordingly. It is advantageous here to couple the devices 20*a* and 20*b* for sealing to the device 40 for removal of the ink cartridge so that the ink cartridge is closed completely by a single combined motion.

In regard to all of the embodiments, it must be stated that the technical features referenced in connection with one embodiment can be employed not only with that specific embodiment but also with the other embodiments. All of the disclosed technical features of this specification must be classified as essential to the invention, and are combinable with each other in any way desired or are usable all alone.

We claim:

1. In combination with a printing machine or unit having a roll rotatable about an axis having a radially outwardly directed roll surface, an ink cartridge comprising:

a housing having a movable side wall, a fixed side wall, and a pair of end walls bridging the fixed and movable side walls and defining therewith a downwardly open mouth juxtaposed with the roll surface, the movable side wall being shiftable between an outer position defining with the fixed side wall and end walls a first volume and an inner position defining with the fixed side wall and end walls a second volume;

respective movable and fixed doctor blades supported on the housing flanking the mouth and having outer edges resiliently engageable at the mouth with the surface, whereby a body of ink can be held between the blades and engage the surface between the outer edges of the blades, the movable doctor blade being attached to the movable side wall and shiftable therewith on the housing between an open position with its outer edge spaced from the outer edge of the fixed doctor blade and a closed position with the outer edges engaging each other and the blades closing the mouth; and means connected to the movable side wall and to the movable doctor blade for shifting the movable doctor blade between the open position and the closed position and for generally simultaneously shifting the movable side wall between the inner position and the outer position by pivoting an upper portion of the movable wall outward away from the fixed wall while pivoting a lower portion of the movable side wall inward toward the fixed side wall such that, as the movable doctor blade moves, a depth of the body of ink in the cartridge remains generally constant.

2. The combination defined in claim 1, further comprising:

axially spaced flexible bodies carried on the housing and shiftable between outer positions generally disengaged from axial end edges of the doctor blades and inner positions bearing axially against the axial end edges.

3. The combination defined in claim 2, further comprising:

respective actuators engaged between the flexible bodies and the housing and operable to shift the bodies between the inner and outer positions.

4. In combination with a printing machine or unit having a roll rotatable about an axis having a radially outwardly directed roll surface, an ink cartridge comprising:

a housing having a movable side wall having a generally planar inner face and pivotal about an axis generally parallel to the roll axis, a fixed side wall, and a pair of end walls bridging the fixed and movable side walls and defining therewith a downwardly open mouth juxtaposed with the roll surface, the movable side wall being shiftable between an outer position defining with the fixed side wall and end walls a first volume and an inner position defining with the fixed side wall and end walls a second volume;

respective movable and fixed doctor blades supported on the housing flanking the mouth and having outer edges resiliently engageable at the mouth with the surface, whereby a body of ink can be held between the blades and engage the surface between the outer edges of the blades, the movable doctor blade being attached to the movable wall shiftable therewith on the housing between an open position with its outer edge spaced from the outer edge of the fixed doctor blade and a closed position with the outer edges engaging each other and the blades closing the mouth; and means connected to the movable side wall and to the movable doctor blade for shifting the movable doctor blade between the open position and the closed position and for generally simultaneously pivoting the movable wall about the axis between the inner position and the outer position by pivoting an upper portion of the movable wall outward away from the fixed wall while pivoting a lower portion of the movable wall inward toward the fixed wall such that, as the movable doctor blade moves, a depth of the body of ink in the cartridge remains generally constant.

5. The ink cartridge defined in claim 4 wherein the movable side wall is rigid.

6. The ink cartridge defined in claim 5 wherein the movable doctor blade is a flexible sheet and is fixed to a lower edge of the movable side wall for joint movement therewith.

7. In combination with a printing machine or unit having a roll rotatable about an axis having a radially outwardly directed roll surface, an ink cartridge comprising:

a housing having a movable side wall, a fixed side wall, and a pair of end walls bridging the fixed and movable side walls and defining therewith a downwardly open mouth juxtaposed with the roll surface, the movable side wall being shiftable between an outer position defining with the fixed side wall and end walls a first volume and an inner position defining with the fixed side wall and end walls a second volume;

respective movable and fixed doctor blades supported on the housing flanking the mouth and having outer edges resiliently engageable at the mouth with the surface, whereby a body of ink can be held between the blades and engage the surface between the outer edges of the blades, the movable doctor blade being attached to the movable wall shiftable therewith on the housing between an open position with its outer edge spaced from the outer edge of the fixed doctor blade and a closed position with the outer edges engaging each other and the blades closing the mouth; and means including a pair of links pivoted on the housing and on the movable side wall in a nonparallelogrammatic manner for shifting the movable doctor blade between the open position and the closed position and for generally simultaneously shifting the movable wall between the inner position and the outer position by pivoting an upper portion of the movable wall outward away from the fixed wall while pivoting a lower portion of the movable wall inward toward the fixed wall such that, as the movable doctor blade moves, a depth of the body of ink in the cartridge remains generally constant.

* * * * *